US008414374B2

(12) United States Patent
Pacey et al.

(10) Patent No.: US 8,414,374 B2
(45) Date of Patent: Apr. 9, 2013

(54) WAGERING GAME ENVIRONMENT INCLUDING AN AD SERVER

(75) Inventors: Larry Pacey, Chicago, IL (US); Laurie Lasseter, Wood Ridge, IL (US); Mark C. Pace, Palatine, IL (US); Shridhar P. Joshi, Naperville, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 12/532,786

(22) PCT Filed: Mar. 19, 2008

(86) PCT No.: PCT/US2008/003596

§ 371 (c)(1),
(2), (4) Date: Sep. 23, 2009

(87) PCT Pub. No.: WO2008/118318

PCT Pub. Date: Oct. 2, 2008

(65) Prior Publication Data

US 2010/0105482 A1 Apr. 29, 2010

Related U.S. Application Data

(60) Provisional application No. 60/896,655, filed on Mar. 23, 2007.

(51) Int. Cl.
*A63F 9/24* (2006.01)

(52) U.S. Cl.
USPC ..... 463/16

(58) Field of Classification Search ..... 463/16
See application file for complete search history.

(56) References Cited

U.S. PATENT DOCUMENTS

| | | | | |
|---|---|---|---|---|
| 5,941,772 | A * | 8/1999 | Paige | 463/20 |
| 6,390,917 | B1 | 5/2002 | Walker et al. | |
| 6,486,891 | B1 * | 11/2002 | Rice | 715/738 |
| 2003/0216961 | A1 | 11/2003 | Barry | |
| 2004/0162759 | A1 | 8/2004 | Willis | |
| 2004/0204213 | A1 * | 10/2004 | Schugar et al. | 463/6 |
| 2006/0063587 | A1 * | 3/2006 | Manzo | 463/25 |
| 2006/0212348 | A1 | 9/2006 | Lambert et al. | |

(Continued)

FOREIGN PATENT DOCUMENTS

ZA 200906523 A1 4/2010

OTHER PUBLICATIONS

"United Kingdom Application Serial No. 0917096.0, Office Action mailed Jun. 24, 2011", 4 pgs.

(Continued)

*Primary Examiner* — Corbett B Coburn
(74) *Attorney, Agent, or Firm* — Schwegman Lundberg & Woessner, P.A.

(57) ABSTRACT

A wagering game machine network including wagering game machines and other devices includes an ad server operable to receive and store ads having ad components. The ads may be sent to any device on the wagering game machine network. Ad components for ads and the ads themselves may be selected based on the capabilities of the device receiving the ad. Ads and ad components may be received from remote ad servers connected to the ad server via a network such as the Internet. Ads may be directed to devices at particular locations, such as a location where a particular wagering game player is located, or where a group of wagering game players having similar demographic characteristics or preferences is located. Ads may be selected based on statistics related to time, ad popularity, payment etc.

26 Claims, 8 Drawing Sheets

U.S. PATENT DOCUMENTS

| | | | | |
|---|---|---|---|---|
| 2007/0060136 | A1* | 3/2007 | Ramer et al. | 455/445 |
| 2007/0087834 | A1* | 4/2007 | Moser et al. | 463/42 |
| 2008/0102916 | A1* | 5/2008 | Kovacs et al. | 463/16 |

OTHER PUBLICATIONS

"United Kingdom Application Serial No. 0917096.0, Response filed Aug. 9, 2011 to Office Action mailed Jun. 24, 2011", 2 pgs.

"International Application Serial No. PCT/US2008/003596, International Search Report and mailed Jul. 7, 2008", 3 pgs.

"International Application Serial No. PCT/US2008/003596, Written Opinion and mailed Jul. 7, 2008", 8 pgs.

"United Kingdom Application Serial No. 0917096.0, Office Action mailed Oct. 10, 2011", 4 pgs.

* cited by examiner

WAGERING GAME ENVIRONMENT INCLUDING AN AD SERVER

RELATED APPLICATION

This patent application is a U.S. National Stage Filing under 35 U.S.C. 371 from International Patent Application Serial No. PCT/US2008/003596 filed Mar. 19, 2008, and published on Oct. 2, 2008, as WO 2008/118318 A1, which claims the priority benefit of U.S. Provisional Patent Application Ser. No. 60/896,655 filed Mar. 23, 2007 and entitled "WAGERING GAME ENVIRONMENT INCLUDING AN AD SERVER", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, 2008 WMS Gaming, Inc.

FIELD

Embodiments of the inventive subject matter relate generally to wagering game systems, and more particularly, to serving advertising on wagering game systems and environments.

BACKGROUND

Wagering game machine makers continually provide new and entertaining games. One way of increasing entertainment value associated with casino-style wagering games (e.g., video slots, video poker, video black jack, and the like) includes offering a variety of base games and bonus events. However, despite the variety of base games and bonus events, players often lose interest in repetitive wagering gaming content. In order to maintain player interest, wagering game machine makers frequently update wagering game content with new game themes, game settings, bonus events, game software, and other electronic data.

While wagering may provide a source of revenue for a gaming establishment or a wagering game maker, other sources of revenue are often desired.

BRIEF DESCRIPTION OF THE FIGURES

Embodiments of the invention are illustrated by way of example and not limitation in the Figures of the accompanying drawings in which.

DESCRIPTION OF THE EMBODIMENTS

Generally speaking, the embodiments of the invention provide systems and methods that provide ads to various devices, both on a gaming network and may display ads to devices on the Internet. Various statistics and information may be used to determine the ads and ad components that are displayed. Internal statistics, such as the popularity of an ad or the availability of a service may be used, as well as external statistics such as payment received from third parties for ad placement may be used to determine which ads are displayed, and may be used to determine a priority for ads. Further, location data may be used to determine where an ad is displayed. The ad content may be reused or combined in varying ways depending on the characteristics or capabilities of the output device that is receiving the ad, thus the ad content may be leveraged across several different types of devices. Further details on the various embodiments will now be discussed.

Example Operating Environment

Example Wagering Game Machine Architecture

Figure 1:
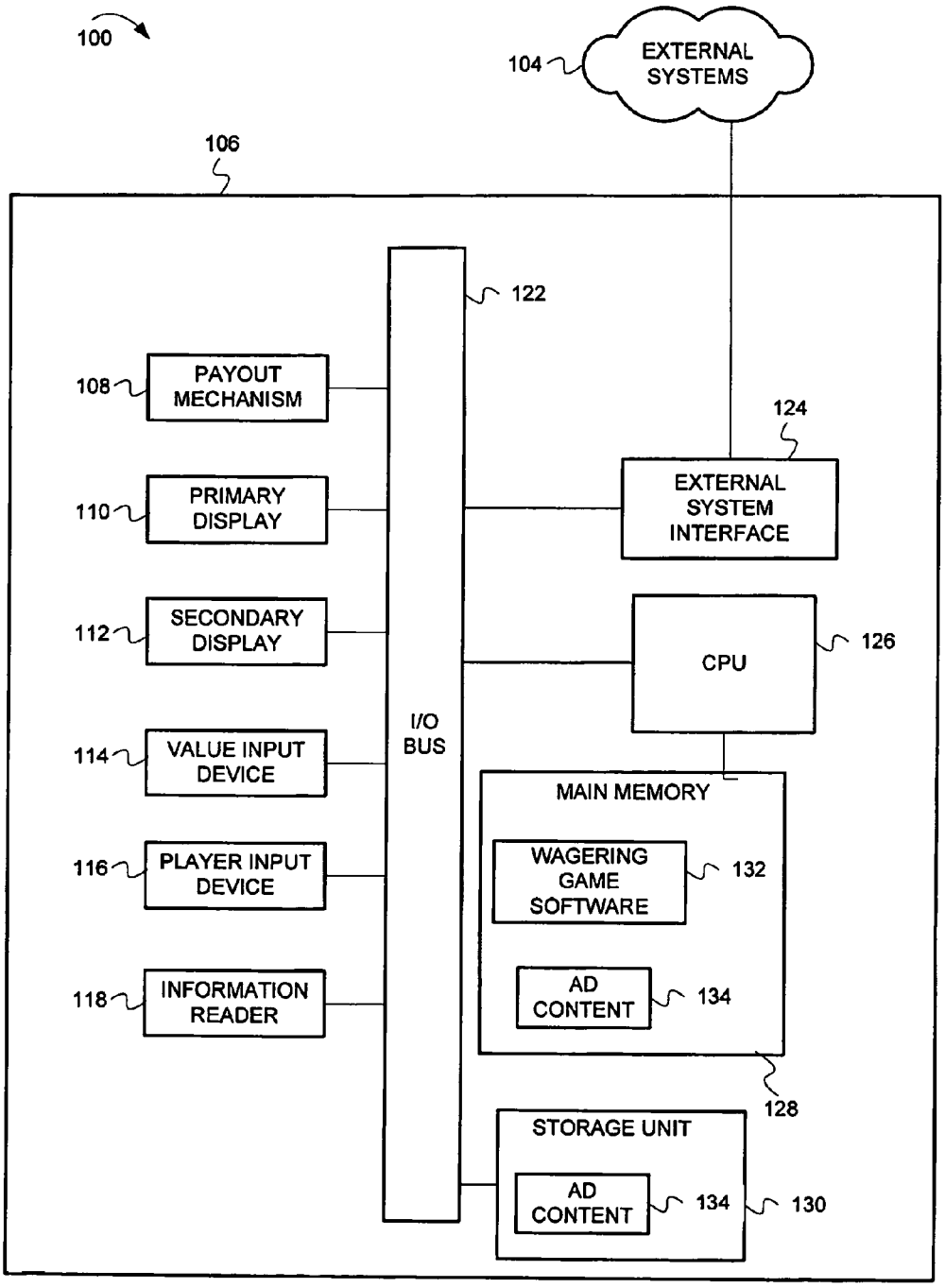
FIG. 1 is a block diagram illustrating a wagering game machine architecture, including a control system, according to example embodiments of the inventive subject matter.

FIG. 1 is a block diagram illustrating a wagering game machine architecture, including a control system, according to example embodiments of the invention. As shown in FIG. 1, the wagering game machine 106 includes a central processing unit (CPU) 126 connected to main memory 128, which includes a wagering game software 132. In one embodiment, the wagering game software 132 can present wagering games, such as video poker, video black jack, video slots, video lottery, etc., in whole or part. Further the software may include applications and data for presenting a wagering game, a bonus round of a wagering game, episodic content, pay tables, denomination data, security data etc.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, and storage unit 130. The player input device 116 can include the value input device 114 to the extent the player input device 116 is used to place wagers. The I/O bus 122 is also connected to an external system interface 124, which is connected to external systems 104 (e.g., wagering game networks).

In some embodiments, either of main memory 128 or storage unit 132 may include advertising content 134 and software for displaying advertising content. In addition to the ads or ad components themselves, the ad content 134 may include lists of ads, priorities for ads, responses to ads or other advertising related data. Further details on the display of ad content are provided below.

In one embodiment, the wagering game machine 106 can include additional peripheral devices and/or more than one of each component shown in FIG. 1. For example, in one embodiment, the wagering game machine 106 can include multiple external system interfaces 124 and multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 can include hardware, firmware, and/or software for performing the operations described herein. Machine-readable media includes any mechanism that provides (e.g., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
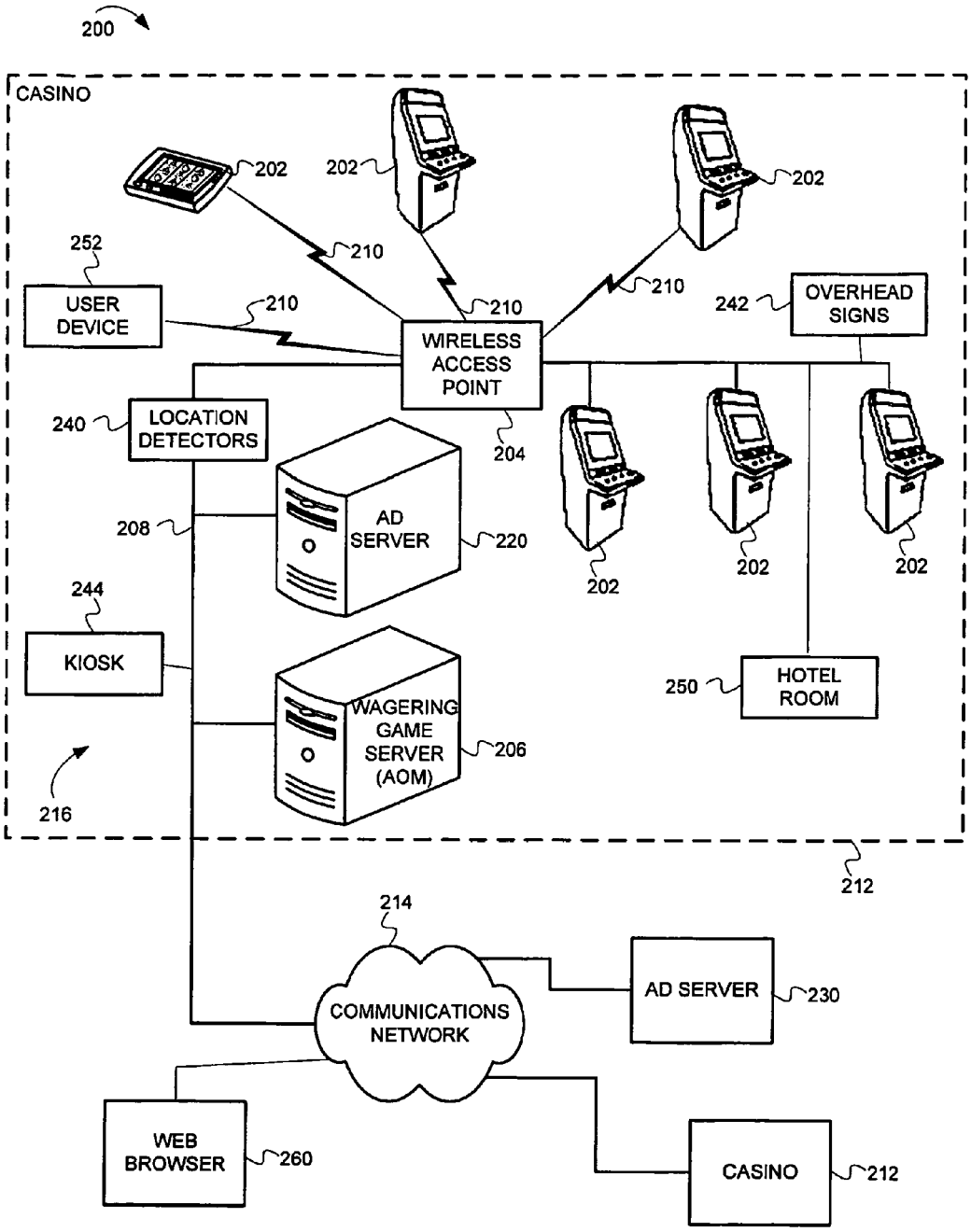
FIG. 2 is a block diagram illustrating a wagering game network, according to example embodiments of the inventive subject matter.

While FIG. 1 describes example embodiments of a wagering game machine architecture, FIG. 2 shows how a plurality of wagering game machines and ad servers can be connected in a wagering game network.

Example Wagering Game Network

FIG. 2 is a block diagram illustrating a wagering game network 200, according to example embodiments of the invention. As shown in FIG. 2, the wagering game network 200 includes a plurality of casinos 212 connected to a communications network 214. Additionally, one or more ad servers 230 or web browsers 260 may also be connected to communications network 214

Each of the plurality of casinos 212 includes a local area network 216, which may include a wireless access point 204, wagering game machines 202, an ad server 220 that serves ads to various devices connected to network 216, and a wagering game server 206 that can serve wagering games over the local area network 216. As such, the local area network 216 includes wireless communication links 210 and wired communication links 208. The wired and wireless communication links can employ any suitable connection technology, such as Bluetooth, 802.11, Ethernet, public switched telephone networks, SONET, etc. In one embodiment, the wagering game server 206 can serve wagering games and/or distribute content to devices located in other casinos 212 or at other locations on the communications network 214. Similarly, ads may be served to the various devices on network 216 through a local ad server 220, or a remote ad server 230.

The wagering game machines 202 described herein can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc. Similarly, user devices 252 may include devices that do not present a wagering game, but may be brought into a casino by a user. Examples of such devices include, but are not limited to, mobile phones, personal digital assistants, personal computers, laptop computers, intelligent player tracking cards etc.

In some embodiments, the wagering game network 200 can include other network devices, such as signs 242, kiosks 244, location detectors 250, and network devices coupled to the network 216 from a hotel room 250. Signs 242 are signs that may be distributed throughout a casino, including signs in wagering areas and non-wagering areas (e.g., lobby, restaurant, pool area, hallway, restroom etc.). The signs typically include an electronic display and/or audio capability to present content received by the sign over network 216. The content may by dynamically updated, and the content may be different from one sign to another.

Kiosk 244 provides a display for content that may be obtained over network 216 and may be configured to provide goods, services, software or information. For example, a kiosk 244 may provide portable wagering devices or wagering software for use on a portable device. Alternatively, kiosk 244 may provide Automated Teller Machine services. Further, kiosk 244 may provide information about the facilities available at a casino or in the surrounding area.

Various devices may be connected to network 216 in a hotel room 250. For example, a television and keyboard may be connected either wired or wirelessly to network 216. Similarly, a network jack or access point may allow a person staying at a hotel associated with a casino to access network 216 using their personal or laptop computer.

In some embodiments, one or more location detectors 240 may be coupled to network 216 in a wired or wireless mode. Various types of location detectors may be used, including passive or active RFID (Radio Frequency Identification), GPS (Global Positioning System), inertial navigation systems, or other location detection mechanisms. Further, location detectors may uses wireless signals or beacons to determine a location for a device carried by a user. Further, multiple location detectors may use the signal strength or timing to triangulate a position for a device carried by a user. Wireless access point 204 may also include such location detection functionality. The location data may be based on signals received from a portable wagering game machine, or from a user device such as a cell phone, personal digital assistant (PDA), or wireless device. The location data may be used to determine an ad to send to either the user's device or to a device near the user that is capable of displaying an ad such as an overhead sign 242 or an idle gaming machine 202.

In some embodiments, a local ad server 220 and one or more remote ad servers 230 may be organized in a tree structure, with the remote ad servers 230 providing regional ad services and local ad servers 220 providing localized ads. The tree structured configuration would thus allow ad frequency or rate settings to be established at a top level while providing the ability to allow destination specific local ad programming.

Further, the network 216 may include accounting servers, wide area progressive servers, player tracking servers, and/or other devices suitable for use in connection with embodiments of the invention.

In various embodiments, wagering game machines 202 and wagering game servers 206 work together such that a wagering game machine 202 may be operated as a thin, thick, or intermediate client. For example, one or more elements of game play may be controlled by the wagering game machine 202 (client) or the wagering game server 206 (server). Game play elements may include executable game code, lookup tables, configuration files, game outcome, audio or visual representations of the game, game assets or the like. In a thin-client example, the wagering game server 206 may perform functions such as determining game outcome or managing assets, while the wagering game machine 202 may be used merely to present the graphical representation of such outcome or asset modification to the user (e.g., player). In a thick-client example, game outcome may be determined locally (e.g., at the wagering game machine 202) and then communicated to the wagering game server 206 for recording or managing a player's account.

Similarly, functionality not directly related to game play may be controlled by the wagering game machine 202 (client) or the wagering game server 206 (server) in embodiments. For example, power conservation controls that manage a display screen's light intensity may be managed centrally (e.g., by the wagering game server 206) or locally (e.g., by the wagering game machine 202). Other functionality not directly related to game play may include presentation of advertising, software or firmware updates, system quality or security checks, etc.

The various devices described above, including wagering game machines 202, ad server 220 and wagering game server 206 can include hardware and machine-readable media including instructions for performing the operations described herein.

Further details on the operation of the above-described devices are provided below with reference to FIGS. 3-5. Details on an example wireless environment are described next.

Example Wireless Environment

In some embodiments, the wireless access point 204 can be part of a communication station, such as wireless local area network (WLAN) communication station including a Wireless Fidelity (WiFi) communication station, or a WLAN access point (AP). In these embodiments, the wagering game machines 202 can be part of a mobile station, such as WLAN mobile station or a WiFi mobile station.

In some other embodiments, the wireless access point 204 can be part of a broadband wireless access (BWA) network communication station, such as a Worldwide Interoperability for Microwave Access (WiMax) communication station, as the wireless access point 204 can be part of almost any wireless communication device. In these embodiments, the wagering game machines 202 can be part of a BWA network communication station, such as a WiMax communication station.

In some embodiments, any of the wagering game machines 202 can be part of a portable wireless communication device, such as a personal digital assistant (PDA), a laptop or portable computer with wireless communication capability, a web tablet, a wireless telephone, a wireless headset, a pager, an instant messaging device, a digital camera, a television, a medical device (e.g., a heart rate monitor, a blood pressure monitor, etc.), or other device that can receive and/or transmit information wirelessly.

In some embodiments, the wireless access point 204 and the wagering game machines 202 can communicate RF signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, but they can also be suitable to transmit and/or receive communications in accordance with other techniques and standards. In some BWA network embodiments, the wireless access point 204 and the wagering game machines 202 can communicate RF signals in accordance with the IEEE 802.16-2004 and the IEEE 802.16(e) standards for wireless metropolitan area networks (WMANs) including variations and evolutions thereof. However, they can also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," Can 2005 and related amendments/versions.

In some embodiments, the wireless access point 204 and the wagering game machines 202 can communicate in accordance with standards such as the Pan-European mobile system standard referred to as the Global System for Mobile Communications (GSM). In some embodiments, the wireless access point 204 and the wagering game machines 202 can also communicate in accordance with packet radio services such as the General Packet Radio Service (GPRS) packet data communication service. In some embodiments, the wireless access point 204 and the wagering game machines 202 can communicate in accordance with the Universal Mobile Telephone System (UMTS) for the next generation of GSM, which can, for example, implement communication techniques in accordance with 2.5G and third generation (3G) wireless standards (See 3GPP Technical Specification, Version 3.2.0, March 2000). In some of these embodiments, the wireless access point 204 and the wagering game machines 202 can provide packet data services (PDS) utilizing packet data protocols (PDP). In other embodiments, the wireless access point 204 and the wagering game machines 202 can communicate in accordance with other standards or other air-interfaces including interfaces compatible with the enhanced data for GSM evolution (EDGE) standards (see 3GPP Technical Specification, Version 3.2.0, March 2000).

In other embodiments, the wireless access point 204 and the wagering game machines 202 can communicate in accordance with a short-range wireless standard, such as the Bluetooth™ short-range digital communication protocol. Bluetooth™ wireless technology is a de facto standard, as well as a specification for small-form factor, low-cost, short-range radio links between mobile PCs, mobile phones and other portable devices. (Bluetooth is a trademark owned by Bluetooth SIG, Inc.) In other embodiments, the wireless access point 204 and the wagering game machines 202 can communicate in accordance with an ultra-wideband (UWB) communication technique where a carrier frequency is not used. In other embodiments, the wireless access point 204 and the wagering game machines 202 can communicate in accordance with an analog communication technique. In other embodiments, the wireless access point 204 and the wagering game machines 202 can communicate in accordance with an optical communication technique, such as the Infrared Data Association (IrDA) standard. In some embodiments, the wireless access point 204 and the wagering game machines 202 can communicate in accordance with the Home-RF standard which can be in accordance with a Home-RF Working Group (HRFWG) standard.

Figure 3A:
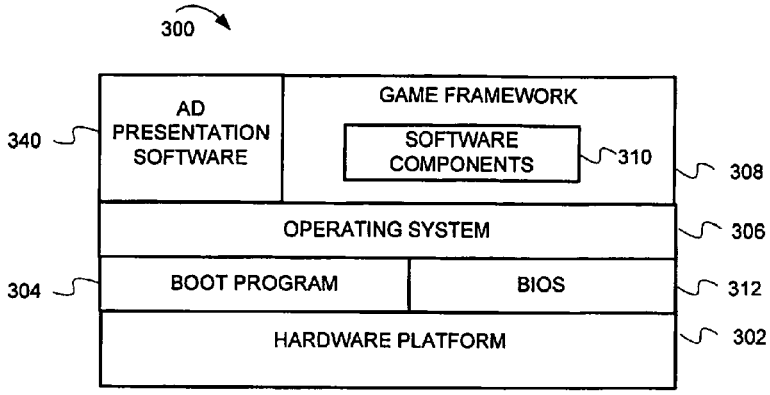
FIGS. 3A and 3B are block diagrams of a software and hardware architecture for a wagering game machine, according to example embodiments of the inventive subject matter.
Figure 3B:
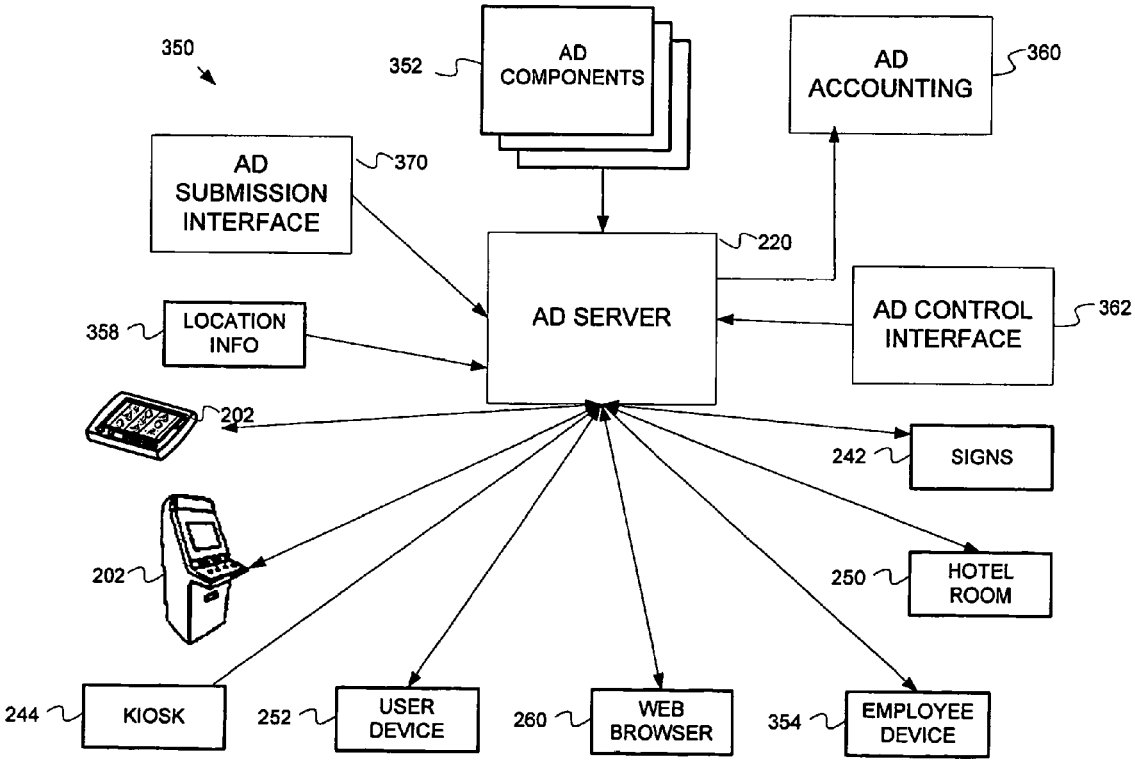

FIGS. 3A and 3B are block diagrams of a software and hardware architecture for a wagering game machine, according to example embodiments of the inventive subject matter. Referring now to FIG. 3A, there is illustrated a block diagram of a software and hardware architecture 300 for a wagering game machine according to example embodiments of the inventive subject matter. As shown in FIG. 3A, the wagering game architecture includes a hardware platform 302, a boot program 304, an operating system 306, and a game framework 308 that includes one or more wagering game software components 310. In various embodiments, the hardware platform 302 may include a thin-client, thick-client, or some intermediate derivation. The hardware platform 302 may also be configured to provide a virtual client. Further, the hardware platform may be based on wagering game machine architecture 100 illustrated in FIG. 1.

The boot program 304 may include a basic input/output system (BIOS) 312 or other initialization program that works in conjunction with the operation system 306 to provide a software interface to the hardware platform 302. The game framework 308 may include standardized game software components either independent or in combination with specialized or customized game software components that are designed for a particular wagering game. In one example embodiment, the wagering game software components 310 may include software operative in connection with the hardware platform 302 and operating system 306 to present wagering games, such as video poker, video black jack, video slots, video lottery, etc., in whole or part. According to another example embodiment, the software components 310 may include software operative to accept a wager from a player. According to one example embodiment, the game software components 310 include one or more components to present ad on a wagering game machine during the play of a wagering game. According to another example embodiment, one or more of the software components 310 may be provided as part of the operating system 306 or other software used in the wagering game system 300 (e.g., libraries, daemons, common services, etc.).

In some embodiments, ad presentation software 340 may receive ad content from an ad server or other source and present the ad content on a wagering game machine in areas outside of wagering game play. For example, ad presentation software 340 may present ads on a secondary display, during attract or idle mode operation, or as part of a wagering game selection menu. Further, ad presentation software may coordinate or prioritize ads presented by software components 310. Further, ad presentation software 340 may receive lists of ads or priorities for ads that are resident on a memory of a wagering game machine and use the list or priority to determine which ads are to be displayed on the wagering game machine.

Referring now to FIG. 3B, a block diagram illustrates the major logical and physical components of an ad presentation system 350 according to embodiments of the inventive subject matter. In some embodiments, ad components 352 are provided to an ad server 220 for prioritization and/or distribution to various devices on a wagering game network.

The ad components 352 may be complete ads, various versions of complete ads, or they may be various audio, video and image components that may be grouped or included together in various combinations to form an ad that is then distributed to a device on a wagering game network. The components and ads may comprise pictures, animations, videos and audio tracks. Additionally, the ad content may include URL (Uniform Resource Locator) information for later use, for example, when the user has an available Internet connection. Further, the components may include programmed ads. For example, ads coded using Java, Adobe Flash or other suitable programming or multimedia creation environment may potentially operate in different ways when they are invoked depending on logic or conditions within the programmed ad. The programmed ads may present a "mini-game" version of a new wagering game that is about to be introduced in order to generate interest in the new wagering game. Further, ad content may be controlled by an API (Application Program Interface) layer that provides the ability to create sophisticated ads with dynamic content.

The ad content may be a "pop-up" ad that replaces or overlays a current game. Further the ad may be an "easter egg" style ad the is periodically inserted for a user to discover. The pop-up ad or easter egg add may provide a free play of the next wagering game, a preview of a new wagering game, or a sweepstakes entry into a progressive pool that is to be awarded at some future time.

As illustrated in FIG. 3B, the ad content 352 may be distributed to many different types of devices. For example, ads or ad components may be distributed to a wagering game machine (either portable or standalone) 202 for display to a user of the device. Similarly, ads or ad components may be distributed to a kiosk 244, a sign 242, a device 250 in a hotel room such as an internet enabled television or room occupant device such as a laptop or other device. Ad content may be sent to a user's web browser 260 while the user browses a casino site from their home, office, or any other Internet accessible location.

Additionally, ad content 352 may be sent to a user's device such as a cell phone, PDA, or other mobile device having wireless communications capability. For example, the system may periodically "ping" for the presence of a user's Bluetooth enabled device. Upon detecting the presence of the device, an offer or ad may be sent to the device. Additionally, the user device may be a player tracking card with an integrated display, such as an LCD display.

Further, content may be sent to a gaming establishment employee's handheld or portable device to indicate that the employee should greet or offer a service to a particular gaming establishment patron. For example, a player tracking system may identify that a high roller or other valued wagering game user is currently playing at a particular wagering game machine. Content may be sent to a gaming establishment employee indicating that the employee should go to the machine currently in user by the patron and greet the patron and perhaps make the patron aware of services (e.g. restaurant and/or shows) that may be of interest to the patron.

In each of the above cases, the ad content may be provided in a format that is adapted to the intended receiving device based on the devices characteristics or capabilities of the device (e.g. resolution, size, bandwidth, storage capability etc.). For example, the ad content may be provided in a larger format or increased resolution for an overhead sign 242 or web browser 260 than for a portable wagering game machine 202. Similarly, the number of ad components that are presented may vary depending on the intended receiving device. For example, a sign 242 or a web browser 260 may be able to display more ad components than a display on a portable wagering game machine 202.

Ad server 220 may receive location information 358 from location detectors. Such location information may be used in a number of ways. For example, the location information may be used to determine an ad to send based on a casino patron's location in a casino. Further, location information for wagering game machine players may be combined with demographic information in order to determine an ad to place on a sign near a group of players having similar demographic characteristics, where the ad is designed to appeal to that demographic group.

Ad content 352 may be provided to an ad server through an ad submission interface 370. In these embodiments, ads may be selected and downloaded to the ad server 220 for later distribution to the various devices described above. Further, timing or priority of ads may be set using the ad submission interface. In some embodiments, ad submission interface 370 may be limited to use by casino or gaming establishment personnel. In alternative embodiments, third parties such as advertisers may use the ad submission interface to submit and/or schedule ad content for distribution to devices on a wagering game machine network. In some embodiments, submissions may be enabled, disabled or moderated by an operator of the system.

Some embodiments include an ad accounting system 360. Ad accounting system 360 may be used to receive data regarding the number of times an ad is displayed to devices on the wagering game machine network and to generate data that may be used to determine billing information regarding the ad. For example, click through data may be received by ad accounting system 360.

Some embodiments include an ad control interface 362. Ad control interface 362 may be used to provide operator control of the ads that are displayed. For example, an operator may determine that a show is not sold out and elevate the priority of ads for the show. Or an operator may have local knowledge based on past experience of ads that are effective for a particular location, time or event.

Figure 4A:
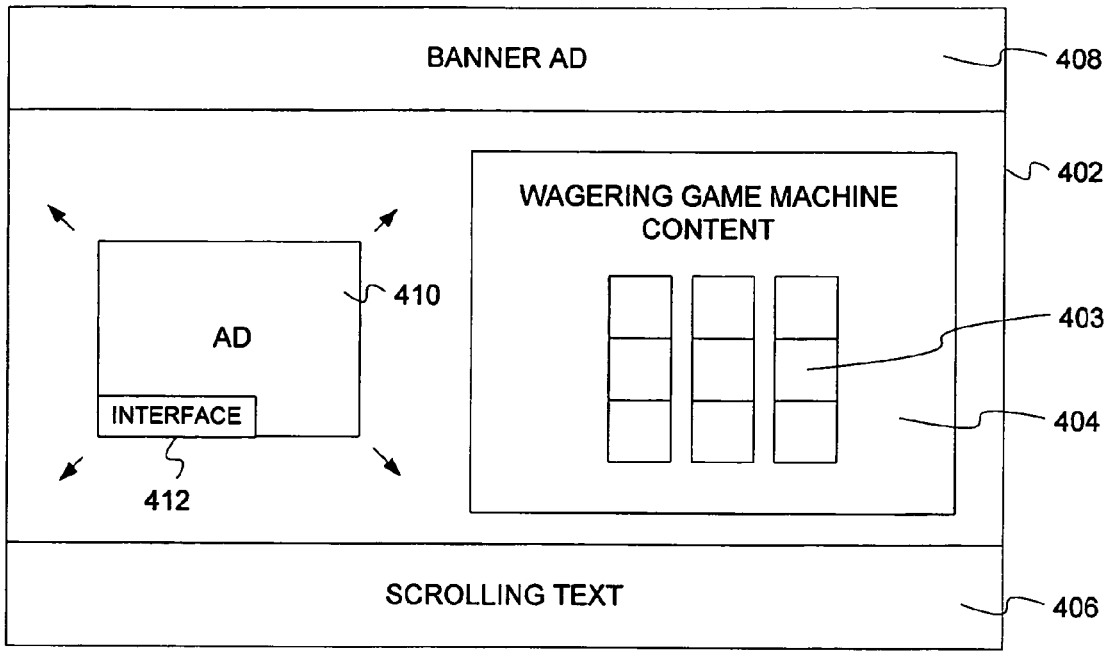
FIGS. 4A and 4B are block diagrams illustrating example screen layouts for a wagering game machine according to example embodiments of the inventive subject matter.
Figure 4B:
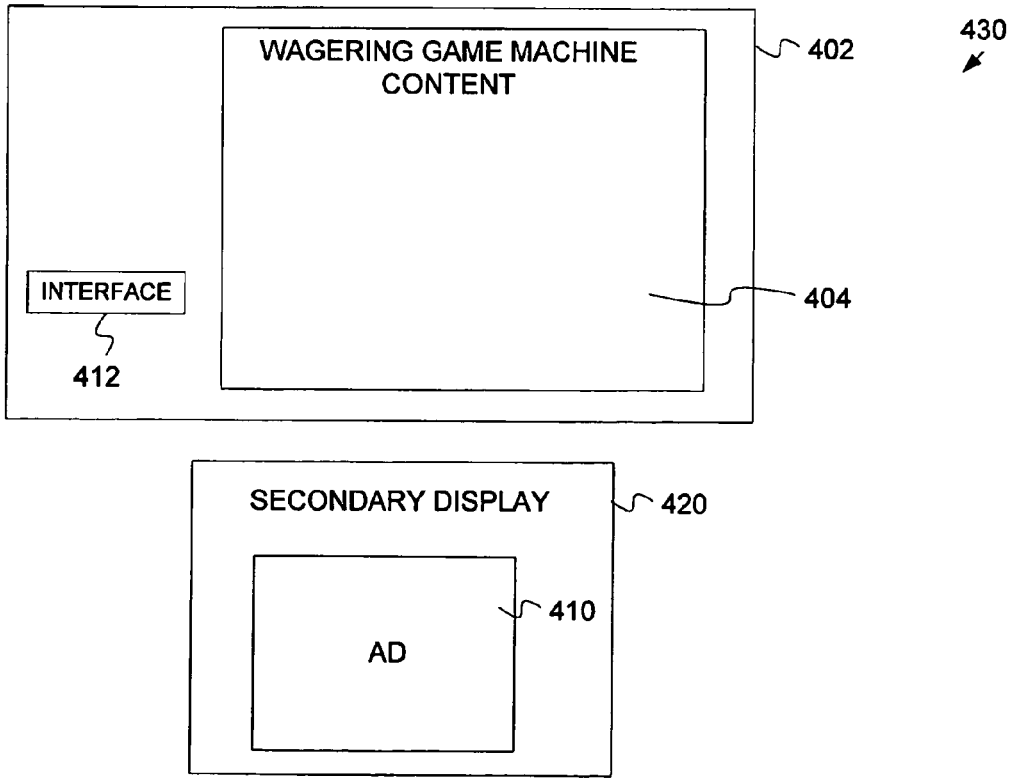

FIGS. 4A and 4B are block diagrams illustrating example screen layouts for a wagering game machine according to example embodiments of the inventive subject matter. FIG. 4A provides an example screen layout 402 illustrating various modes for displaying ads on a wagering game machine. In some embodiments, ads may be displayed as a banner ad 408 that appears on a display of the wagering game machine. The banner ad 408 may appear at the top, bottom sides or at any other location on the display.

In further embodiments, ads may be displayed as scrolling region 406 that appears on the display of the wagering game machine. The content of the ad scrolls through the space allocated for the ad. For example, the text may scroll from right to left, top to bottom, or bottom to top. Further the scrolling region 406 may be located anywhere in the display of the wagering game machine. However, it may be desirable to locate the scrolling text region in an area that does not have a significant effect on wagering game play such as adjacent to the edge of the display.

Various types of ads or other content may be presented in the scrolling region 406. For example, sports scores, news events, stock quotes, RSS (Really Simple Syndication) feeds, or other content, including real-time content, may be interspersed with ad content that scrolls across the scrolling region 406.

Further, an adjustable ad space 410 may exist on the wagering game display. In these embodiments, the ad space 410 may be display with an initial size, and the size may be adjusted upward or downward upon the occurrence of various events. For example, the ad space 410 may adjust upward upon the completion of a wagering game, upon detection that a pointing device has moved over the ad space 410, Or upon the selection of a user interface element such as a button, menu or icon within an interface 412 provided in the ad space. Similarly, ad space 410 may adjust downward upon the resumption or initiation of a wagering game, upon detecting that a cursor or pointing device has moved out of the ad space 410, or upon the selection of a user interface element such as a button, menu or icon of interface 412. In addition to controlling the size of an ad space 410, interface 412 may be used to provide a response interface to select an ad or a portion of an ad to indicate the user is interested in the ad or wishes to accept an offer provided by the ad.

In some embodiments, as ad space 410 adjusts in size, the size of a display area 404 for wagering game content may be adjusted in an inverse manner to the adjustment of ad space 410. In other words, as the ad space grows, the display area 404 shrinks and vice versa. The display area 404 for wagering game content may be displaying a wagering game, an idle or attract mode presentation, or a menu allowing for the selection of wagering games available on the wagering game machine.

In some embodiments, ads may be placed on symbols 403 associated with a wagering game. For example, an ad may be placed over a symbol representing a reel on a video slot machine. A new ad may be placed after each reel spin.

It should be noted that various combinations of the layouts described in the above examples may be used and that embodiments exist that do not require the use of any or all of the layouts described above.

The layouts described above may be used for both wagering game machines that have a single primary display, and for wagering game machines that have both a primary display and at least one secondary display. Further, FIG. 4B provides an example screen layout 430 illustrating various modes for displaying ads on a wagering game machine having a primary display 402 and at least one secondary display 420. In some embodiments, ads are displayed in a display area 410 on secondary display 420. An interface 412 on primary display 402 may be used to control the size, location, or responses to an ad in display area 410.

The secondary display may be a display used to present a bonus round, a display on a top box of a wagering game machine, or a display behind a belly glass of a wagering game machine. Additionally, the secondary display may be on a completely different device. For example, the primary display may be on a wagering game machine while the secondary display may be an LCD on a player tracking card.

Similarly, the interface 412 may be on a player tracking card which may be used to control aspect of the display of an ad on a wagering game machine. Thus the interface and the ad display may be on completely different devices.

Example Operations

Figure 5A:
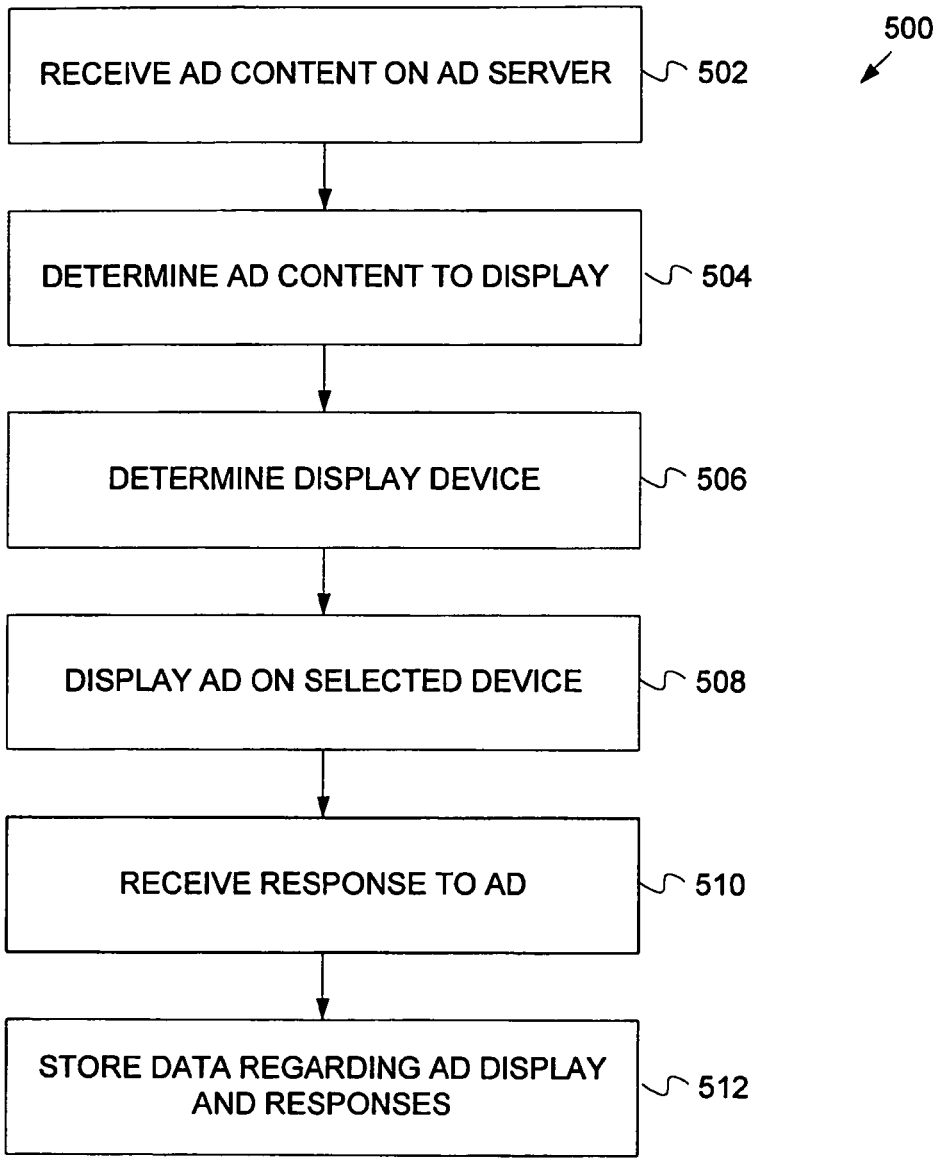
FIGS. 5A and 5B are flowcharts illustrating methods for providing ad content on a wagering game machine or other device in a wagering game network according to embodiments of the inventive subject matter.
Figure 5B:
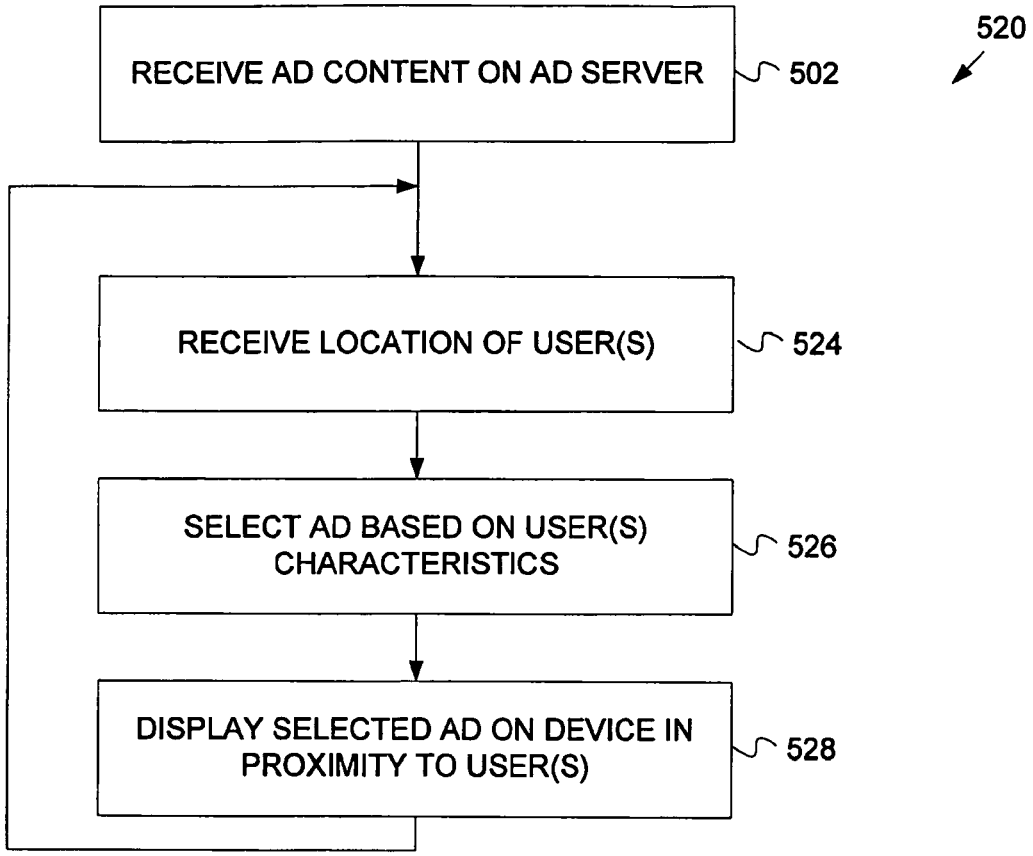

FIGS. 5A and 5B are flowcharts illustrating methods for providing ad content on a wagering game machine or other device in a wagering game network according to embodiments of the inventive subject matter.

Referring to FIG. 5A, a method 500 for displaying ad content on a device in a wagering game network is shown. The method begins at block 502 by receiving ad content to be displayed. As noted above, there may be a variety of sources for ad content. For example, the ad content may be loaded onto an ad server from a portable persistent storage media such as a compact flash memory, CD-ROM, DVD-ROM, or other storage media. Alternatively, the ad content may be loaded onto an ad server via a network such as a LAN, WAN, intranet, or the Internet. Further, ad content may be submitted to the ad server over a network through an ad submission interface as discussed above.

At block 504 the ad server determines ad content to be displayed on a device. Various factors may be considered and combined when determining the ad content to display. These factors may include various combinations of one or more of the following:

- A prioritized list of ads may be used, with ads displayed in the order based on their priority. The priority may be based on ad popularity, which may be determined by responses received to the ad. Further, popularity may be determined using regression analysis or cluster analysis.
- Ads may be displayed based on a time of day, day of week, or time of year.

Ads may be selected based on location with a casino. For example, ads for a restaurant may be displayed near at one location while ads for a show may be displayed at another location.

Ads may be selected based on availability of a casino feature. For example, if a show has many seats remaining to be sold, ads for the show may be selected for display to attempt to sell more seats for the show. Alternatively, ads for shows that are sold out may be deselected.

Ads may be selected based on demographic data for a casino or location within a casino.

Ads may be targeted to a particular user (identified for example, by a player tracking card or a wireless device owned by the user). Preference information stored by the system may be used to determine an ad to display. The preferences may be a captive list of preferences, for example preferences learned by asking the user if they prefer one option over another option, or based on offers previously sent and subsequently redeemed by the user. The user may be identified using a player tracking card, RFID, cell phone information, or optical recognition using cameras within a casino or in a wagering game machine.

Ads may be targeted to a particular user based on characteristics learned as the user is in the casino. For example, the color of the user's clothing may be detected by cameras and ads that are designed to appeal to persons that choose that color of clothing may be selected for presentation to a device near the user.

Ads may be prioritized base on events of offers that are about to expire.

Additionally, the ad content may be dynamically generated based on one or more of the above factors. For instance, a base ad may exist that is modified based on the time, market conditions, or characteristics of user. For example, one version of an ad may be presented on weekdays that offers two tickets for a show for the price of one, while on weekends the ad may offer a 10% discount on tickets for the show.

Those of skill in the art will appreciate that a variety of ad selection mechanics are possible and within the scope of the inventive subject matter.

At block 506, a device may be selected to receive an ad for display. Ads targeted to a particular user will be sent to the device currently in being used. Further, ads may be targeted to particular locations, such as signs or displays in various areas of a gaming establishment. Certain types of ads may be displayed in a check-in area of a hotel, while other types of ads may be displayed in restaurants, and still other types of ads may be presented to a device in a hotel room. For example, ads related to smoking may be sent to devices on casino floor, while such ads may not be presented in a restaurant. Similarly ads that may be considered risqué may be sent to a device in a hotel room, but not to a device in a lobby or check-in area. In this manner, the system provides "spatially aware" ads, that is, ads that may be displayed depending on the location of the display device.

A device type or characteristic may also be used to "deselect" a device. For example, an ad for one vendor's beverage product may be deselected such that it will not be allowed to be displayed on a device dispensing a competing vendor's beverage product.

In some embodiments, demographic data may be used to select a device. For example, if a particular wagering game machine or theme is found to appeal to a certain demographic group, ads may be selected that are designed to appeal to that demographic group. As indicated above, a device may be selected based on its location. For example, if a significant percentage of players in a particular location in a casino have similar demographics details, ads targeting that demographic group may be sent to an overhead sign near the group, or to a wagering game machine in attract mode near the group.

Further, the same ad may be sent to multiple devices on a casino floor and timed such that all casino patrons see the ad at the same time.

At block 508, the selected ads are then presented on the selected device. The ad may be presented during game play, during idle mode, during a game selection menu, or during a cashout. Further, the ads may be presented on a display, or they may be printed on a ticket printer or other output device. The ad or offer may comprise a bar code or other code printed on a receipt by a ticket printer that may be redeemed later, for example at a store, restaurant, or other location within or outside of a casino. The code may be used to identify an ad that may be displayed later on a different device upon providing the code to a suitable user interface (e.g. entering the code on a web page configured to receive such codes). Further, the ad, or a code for the ad may be stored to a player tracking card or a player account.

In some embodiments, a user may respond to an ad at block 510. For example, an ad may indicate that the user may redeem an offer or obtain further information by clicking on the ad, by touching the ad (on a touch screen capable device), by pressing a button on a wagering game machine, or through any user interface available to provide a user response. The response may lead to a new ad or web site being displayed to the user on the device. Alternatively, the response may result in a coupon being printed on a ticket printer attached to a wagering game machine.

The response at block 510 may include saving the ad for later display or use. For example, the user may use a user interface to "drag" the ad to a bin that causes the ad to be electronically stored or saved to a user's account. Later, the user can access the account and view the ad. Further, the ad may be communicated to another user, for example using an electronic mail interface.

At block 512, data regarding the ads displayed and the responses received to the ads may be stored. The data may be sent to an ad accounting server in order for the party responsible for the ad to be charged appropriately. Alternatively, the response data may be used and analyzed to determine which ads are popular and which ads are not popular. Regression analysis or cluster analysis may be applied to the response data.

Referring to FIG. 5B, a method 520 according to alternative embodiments for displaying ad content on a device in a wagering game network based on the location of a user or similar group of users is shown. The method begins at block 502 by receiving ad content to be displayed. As noted above, there may be a variety of sources for ad content. As discussed above, the ad content may be loaded onto an ad server from a portable persistent storage media such as a compact flash memory, CD-ROM, DVD-ROM, or other storage media. Alternatively, the ad content may be loaded onto an ad server via a network such as a LAN, WAN, intranet, or the Internet. Further, ad content may be submitted to the ad server over a network through an ad submission interface as discussed above.

At block 524, the system receives the location of a user, or a group of users having similar demographic characteristics. As noted above, the identity and/or location of a user may be determined in a variety of ways, including sensing the location of a portable wagering game machine or other wireless or RFID enabled device being carried by a user, player tracking cards, or optical recognition. In the case of a group of users, the system may determine that a group of users having similar demographic characteristics is clustered in or near a particular location in a casino. Again, the identities and locations of the users in the group may be determined based on devices used or carried by the user, such as wireless devices, portable gaming machines, player tracking cards, etc.

At block 526, the system selects an ad for presentation to the user or group of users. The ad may be selected based on its perceived or measured probability of generating a response from the user or group of users, using any of the methods described above for ad selection based on user preference or demographic characteristics.

At block 528, a device in proximity to the user is determined and the system causes the selected ad to be displayed on the device. The device may be an overhead sign near the user or group of users, a wagering game machine being used by the user, a display on a device being carried by the user, or a wagering game in proximity to the user or group of users.

The method then returns to block 524 to redetermine the location of a user. As will be appreciated by those of skill in the art, the method above provides a means for ads targeting a particular user or group of users to "attach" to the user or groups of users and move along with the user or group of user.

The systems and methods described above may be used to provide ad supported sponsorship of various aspects of game play mechanics. For example, there may be an advertising supported "free" play version of a wagering game in which the user may receive a credit for use in playing a wagering game in return for viewing and/or responding to an ad.

Similarly, game play mechanics may influence the frequency in which ads are allowed to appear on a device. For example, a player betting a minimum amount per payline on a slot machine may receive all ads sent to the slot machine, while a player betting the maximum amount may receive fewer or no ads. Alternatively, a player betting the maximum amount per payline may receive "gold" ads, that is, ads that are considered more desirable because of the nature of the offer presented in the ad.

Sponsorship may extend beyond wagering game play mechanics to AOM (Administration, Operation and Maintenance) features. For instance, third or first party ads (e.g. corporate messages) may displayed on helps screens or administrative screens for a wagering game related machine or server. Further, special AOM features may be enabled in return allowing a party to run ads on an AOM interface.

As can be seen from the above, the embodiments of the invention provide a flexible way to deliver ads that may be machine specific, game specific, time specific, or theme specific. Further, the ads may be targeted to a particular individual, and further, the ads may be spatially aware in that they may follow a person from location to location, or they may be targeted at a group of players in a particular location.

Figure 6:
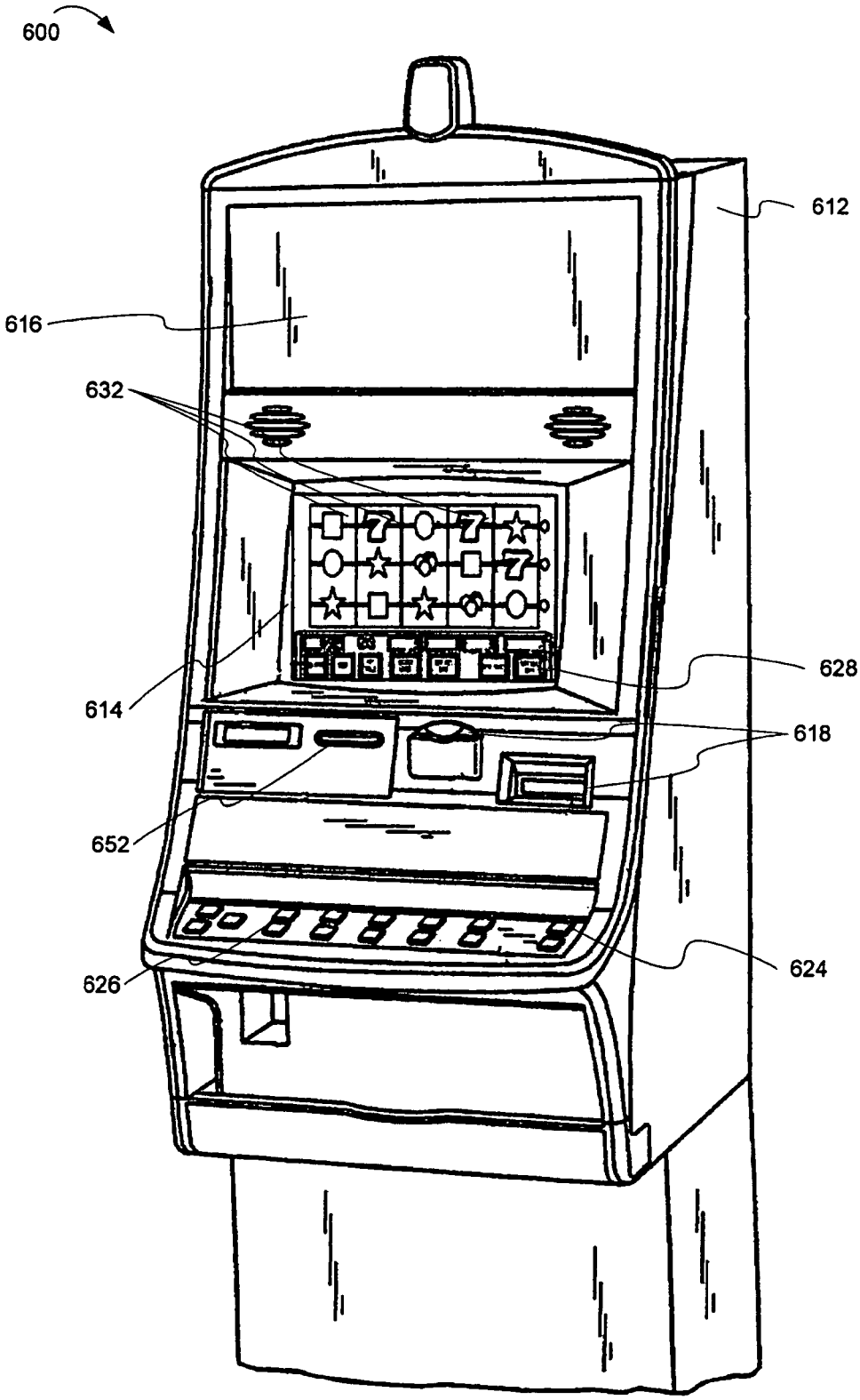
FIG. 6 is a perspective view of a wagering game machine, according to example embodiments of the inventive subject matter.
Figure 7:
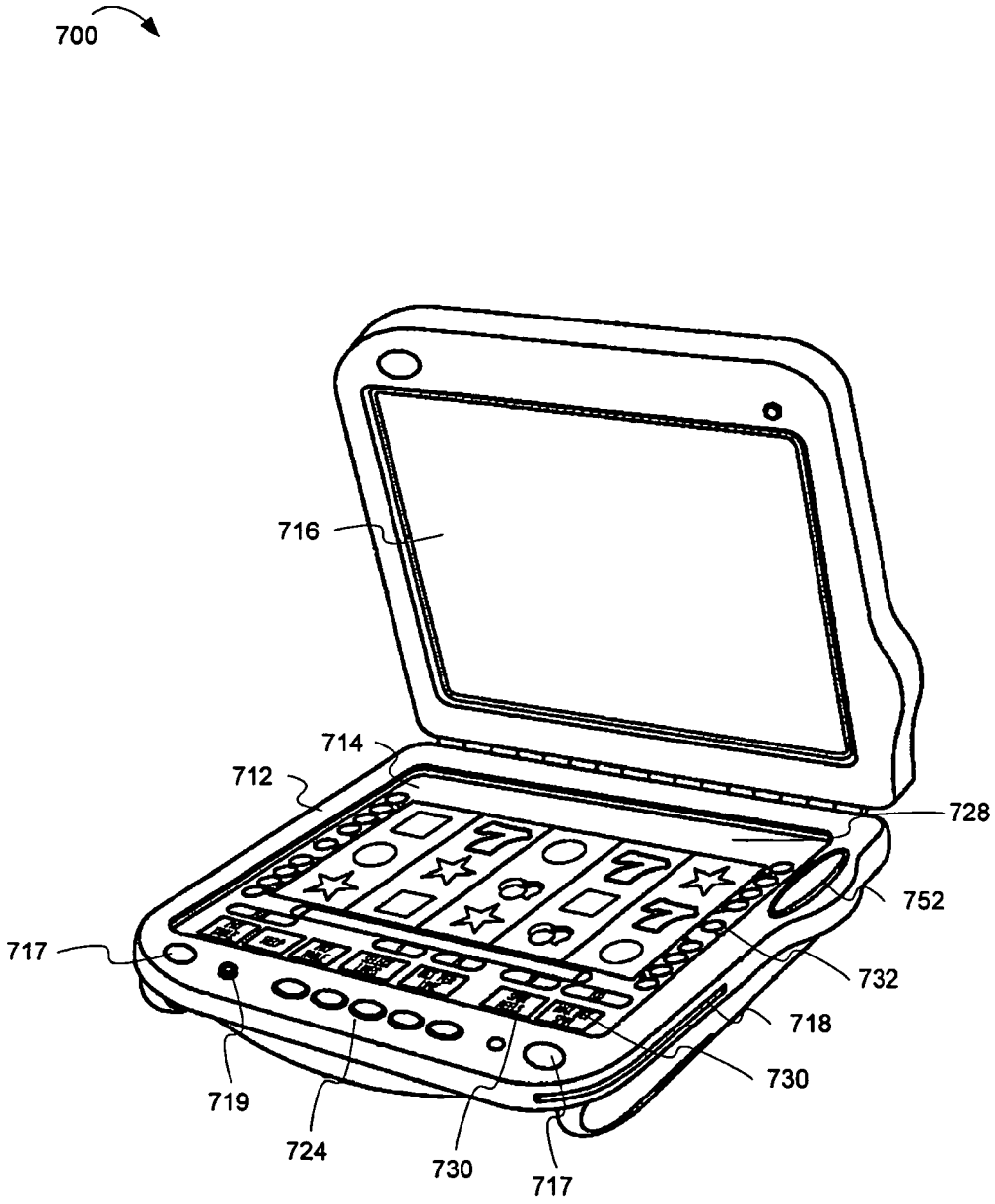
FIG. 7 shows an example embodiment of a portable wagering game machine according to example embodiments of the invention.

The discussion above has described various embodiments that provide advertising content to wagering game machines. FIGS. 6 and 7 below describe various types of wagering game machines that may receive the advertising content.

Example Wagering Game Machines

Example Wagering Game Machine

FIG. 6 is a perspective view of a wagering game machine, according to example embodiments of the invention. Referring to FIG. 6, a wagering game machine 600 is used in gaming establishments, such as casinos. According to embodiments, the wagering game machine 600 can be any type of wagering game machine and can have varying structures and methods of operation. For example, the wagering game machine 600 can be an electromechanical wagering game machine configured to play mechanical slots, or it can be an electronic wagering game machine configured to play video casino games, such as blackjack, slots, keno, poker, blackjack, roulette, etc.

The wagering game machine 600 comprises a housing 612 and includes input devices, including value input devices 618 and a player input device 624. For output, the wagering game machine 600 includes a primary display 614 for displaying information about a basic wagering game. The primary display 614 can also display information about a bonus wagering game and a progressive wagering game. The wagering game machine 600 also includes a secondary display 616 for displaying wagering game events, wagering game outcomes, and/or signage information. While some components of the wagering game machine 600 are described herein, numerous other elements can exist and can be used in any number or combination to create varying forms of the wagering game machine 600.

The value input devices 618 can take any suitable form and can be located on the front of the housing 612. The value input devices 618 can receive currency and/or credits inserted by a player. The value input devices 618 can include coin acceptors for receiving coin currency and bill acceptors for receiving paper currency. Furthermore, the value input devices 618 can include ticket readers or barcode scanners for reading information stored on vouchers, cards, or other tangible portable storage devices. The vouchers or cards can authorize access to central accounts, which can transfer money to the wagering game machine 600.

The player input device 624 comprises a plurality of push buttons on a button panel 626 for operating the wagering game machine 600. In addition, or alternatively, the player input device 624 can comprise a touch screen 628 mounted over the primary display 614 and/or secondary display 616.

The various components of the wagering game machine 600 can be connected directly to, or contained within, the housing 612. Alternatively, some of the wagering game machine's components can be located outside of the housing 612, while being communicatively coupled with the wagering game machine 600 using any suitable wired or wireless communication technology.

The operation of the basic wagering game can be displayed to the player on the primary display 614. The primary display 614 can also display a bonus game associated with the basic wagering game. The primary display 614 can include a cathode ray tube (CRT), a high resolution liquid crystal display (LCD), a plasma display, light emitting diodes (LEDs), or any other type of display suitable for use in the wagering game machine 600. Alternatively, the primary display 614 can include a number of mechanical reels to display the outcome. In FIG. 6, the wagering game machine 600 is an "upright" version in which the primary display 614 is oriented vertically relative to the player. Alternatively, the wagering game machine can be a "slant-top" version in which the primary display 614 is slanted at about a thirty-degree angle toward the player of the wagering game machine 600. In yet another embodiment, the wagering game machine 600 can exhibit any suitable form factor, such as a free standing model, bartop model, mobile handheld model, or workstation console model.

A player begins playing a basic wagering game by making a wager via the value input device 618. The player can initiate play by using the player input device's buttons or touch screen 628. The basic game can include arranging a plurality of symbols along a payline 632, which indicates one or more outcomes of the basic game. Such outcomes can be randomly selected in response to player input. At least one of the outcomes, which can include any variation or combination of symbols, can trigger a bonus game.

In some embodiments, the wagering game machine 600 can also include an information reader 652, which can include a card reader, ticket reader, bar code scanner, RFID transceiver, or computer readable storage medium interface. In some embodiments, the information reader 652 can be used to award complimentary services, restore game assets, track player habits, etc.

Example Wagering Game Machine

FIG. 7 shows an example embodiment of a wagering game machine 700. Like free standing wagering game machines, in a handheld or mobile form, the wagering game machine 700 can include any suitable electronic device configured to play a video casino games such as blackjack, slots, keno, poker, blackjack, and roulette. The wagering game machine 700 comprises a housing 712 and includes input devices, including a value input device 718 and a player input device 724. For output, the wagering game machine 700 includes a primary display 714, a secondary display 716, one or more speakers 717, one or more player-accessible ports 719 (e.g., an audio output jack for headphones, a video headset jack, etc.), and other conventional I/O devices and ports, which may or may not be player-accessible. In the embodiment depicted in FIG. 7, the wagering game machine 700 comprises a secondary display 716 that is rotatable relative to the primary display 714. The optional secondary display 716 can be fixed, movable, and/or detachable/attachable relative to the primary display 714. Either the primary display 714 and/or secondary display 716 can be configured to display any aspect of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

The player-accessible value input device 718 can comprise, for example, a slot located on the front, side, or top of the housing 712 configured to receive credit from a stored-value card (e.g., casino card, smart card, debit card, credit card, etc.) inserted by a player. The player-accessible value input device 718 can also comprise a sensor (e.g., an RF sensor) configured to sense a signal (e.g., an RF signal) output by a transmitter (e.g., an RF transmitter) carried by a player. The player-accessible value input device 718 can also or alternatively include a ticket reader, or barcode scanner, for reading information stored on a credit ticket, a card, or other tangible portable credit or funds storage device. The credit ticket or card can also authorize access to a central account, which can transfer money to the wagering game machine 700.

Still other player-accessible value input devices 718 can require the use of touch keys 730 on the touch-screen display (e.g., primary display 714 and/or secondary display 716) or player input devices 724. Upon entry of player identification information and, preferably, secondary authorization information (e.g., a password, PIN number, stored value card number, predefined key sequences, etc.), the player can be permitted to access a player's account. As one potential optional security feature, the wagering game machine 700 can be configured to permit a player to only access an account the player has specifically set up for the wagering game machine 700. Other conventional security features can also be utilized to, for example, prevent unauthorized access to a player's account, to minimize an impact of any unauthorized access to a player's account, or to prevent unauthorized access to any personal information or funds temporarily stored on the wagering game machine 700.

The player-accessible value input device 718 can itself comprise or utilize a biometric player information reader which permits the player to access available funds on a player's account, either alone or in combination with another of the aforementioned player-accessible value input devices 718. In an embodiment wherein the player-accessible value input device 718 comprises a biometric player information reader, transactions such as an input of value to the wagering game machine 700, a transfer of value from one player account or source to an account associated with the wagering game machine 700, or the execution of another transaction, for example, could all be authorized by a biometric reading, which could comprise a plurality of biometric readings, from the biometric device.

Alternatively, to enhance security, a transaction can be optionally enabled only by a two-step process in which a secondary source confirms the identity indicated by a primary source. For example, a player-accessible value input device 718 comprising a biometric player information reader can require a confirmatory entry from another biometric player information reader 752, or from another source, such as a credit card, debit card, player ID card, fob key, PIN number, password, hotel room key, etc. Thus, a transaction can be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 718 can be provided remotely from the wagering game machine 700.

The player input device 724 comprises a plurality of push buttons on a button panel for operating the wagering game machine 700. In addition, or alternatively, the player input device 724 can comprise a touch screen mounted to a primary display 714 and/or secondary display 716. In one aspect, the touch screen is matched to a display screen having one or more selectable touch keys 730 selectable by a user's touching of the associated area of the screen using a finger or a tool, such as a stylus pointer. A player enables a desired function either by touching the touch screen at an appropriate touch key 730 or by pressing an appropriate push button on the button panel. The touch keys 730 can be used to implement the same functions as push buttons. Alternatively, the push buttons 732, can provide inputs for one aspect of the operating the game, while the touch keys 730 can allow for input needed for another aspect of the game. The various components of the wagering game machine 700 can be connected directly to, or contained within, the housing 712, as seen in FIG. 7, or can be located outside the housing 712 and connected to the housing 712 via a variety of wired (tethered) or wireless connection methods. Thus, the wagering game machine 700 can comprise a single unit or a plurality of interconnected (e.g., wireless connections) parts which can be arranged to suit a player's preferences.

The operation of the basic wagering game on the wagering game machine 700 is displayed to the player on the primary display 714. The primary display 714 can also display the bonus game associated with the basic wagering game. The primary display 714 preferably takes the form of a high resolution LCD, a plasma display, an LED, or any other type of display suitable for use in the wagering game machine 700. The size of the primary display 714 can vary from, for example, about a 2-3" display to a 15" or 17" display. In at least some embodiments, the primary display 714 is a 7"-10" display. In one embodiment, the size of the primary display can be increased. Optionally, coatings or removable films or sheets can be applied to the display to provide desired characteristics (e.g., anti-scratch, anti-glare, bacterially-resistant and anti-microbial films, etc.). In at least some embodiments, the primary display 714 and/or secondary display 716 can have a 16:9 aspect ratio or other aspect ratio (e.g., 4:3). The primary display 714 and/or secondary display 716 can also each have different resolutions, different color schemes, and different aspect ratios.

As with the free standing embodiments a wagering gaming machine, a player begins play of the basic wagering game on the wagering game machine 700 by making a wager (e.g., via the value input device 418 or an assignment of credits stored on the handheld gaming machine via the touch screen keys 730, player input device 724, or buttons 732) on the wagering game machine 700. In some embodiments, the basic game can comprise a plurality of symbols arranged in an array, and includes at least one payline 728 that indicates one or more outcomes of the basic game. Such outcomes can be randomly selected in response to the wagering input by the player. At least one of the plurality of randomly selected outcomes can be a start-bonus outcome, which can include any variations of symbols or symbol combinations triggering a bonus game.

In some embodiments, the player-accessible value input device 718 of the wagering game machine 700 can double as a player information reader 752 that allows for identification of a player by reading a card with information indicating the player's identity (e.g., reading a player's credit card, player ID card, smart card, etc.). The player information reader 752 can alternatively or also comprise a bar code scanner, RFID transceiver or computer readable storage medium interface. In one embodiment, the player information reader 752 comprises a biometric sensing device.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. A method for execution by one or more processors, the method comprising:

receiving, by a server on a wagering game machine network, ad components for an ad, the wagering game machine network including one or more wagering game machines operable to present a wagering game upon which monetary value may be wagered;

selecting by the one or more processors one or more devices to present the ad;

selecting by the one or more processors one or more of the ad components for the ad based on the capabilities of the one or more devices to receive the ad;

sending the selected one or more ad components to the one or more devices operable to display the selected ad components to a person in proximity to at least one of the devices, and receive input from the person, the input causing at least a portion of the selected ad components to be stored for later access by the person; and controlling, by the one or more processors and independent from player configuration, the frequency of sending the selected one or more ad components to the one or more devices based on game play characteristics of a player at the one or more devices.

2. The method of claim 1, wherein the one or more devices include the one or more wagering game machines, a kiosk, a sign, a cellular phone, a PDA, a portable wagering game machine, a computer coupled to the wagering game network through a network interface, a computer coupled to the ad server through a second network.

3. The method of claim 1, further comprising receiving the components for the ad from a server located on the Internet.

4. The method of claim 1, further comprising selecting the ad from a plurality of available ads, the selection based on one or more statistics.

5. The method of claim 4, wherein the one or more statistics include one or more of a popularity statistic for a general population, a popularity statistic for a gaming population, or availability of tickets for an event.

6. The method of claim 1, further comprising:

determining a device in proximity to a user;

selecting the ad from a plurality of available ads, the selection based on one or more characteristics associated with the user.

7. The method of claim 6, wherein at least one of the one or more characteristics is determined from a captive list of preferences.

8. The method of claim 6, wherein the at least one or more characteristics include demographics characteristics.

9. The method of claim 1, further comprising selecting the ad from a plurality of available ads based on a priority.

10. The method of claim 9, wherein the priority is determined by one or more of a payment, a popularity statistic, an expiration date of an offer, or a time value.

11. The method of claim 1, further comprising determining an offer for the ad based on one or more of time of day, day of week, day of year, player status, or market location.

12. The method of claim 1, wherein the input from the person causes the portion of the selected ad components to be electronically stored in an account accessible by the person.

13. The method of claim 1, wherein the frequency is inversely proportional to the amount of a wager by the player at the one or more devices.

14. A system comprising:

a wagering game network, the wagering game network including one or more wagering game machines operable to present a wagering game upon which monetary value may be wagered;

a plurality of devices capable of displaying an ad; and an ad server communicably coupled to the wagering game network and operable to:

store one or more ad components for an ad;

select one or more devices from the plurality of devices to present the ad;

select one or more of the ad components for the ad based on the capabilities of the one or more devices to receive the ad; and send the selected ad components to the one or more selected devices, wherein at least one device of the selected devices is operable to:

display the selected ad components to a person at the at least one device;

receive input from the person, the input causing at least a portion of the selected ad components to be stored for later access by the person; and wherein the ad server is operable to control the frequency of sending the selected ad components to the one or more selected devices independent from player configuration and based on game play characteristics of a player at the one or more selected devices.

15. The system of claim 14, wherein the one or more devices include the one or more wagering game machines, a kiosk, a sign, a cellular phone, a PDA, a portable wagering game machine, a computer coupled to the wagering game network through a network interface, a computer coupled to the ad server through a second network.

16. The system of claim 14, wherein the ad is displayed on a gaming symbol of wagering game presented on the one or more wagering game machines.

17. The system of claim 14, wherein a display of the one or more wagering game machines includes a first area for presenting a wagering game and a second area for presenting the ad, and wherein a size of the second area is increased and a size of the first area is decreased upon receiving an input related to the first area.

18. The system of claim 17, wherein the display is touch sensitive and wherein the input includes receiving an indication of a touch within the first area.

19. The system of claim 17, further comprising an ad interface and wherein the input includes receiving input from the ad interface.

20. The system of claim 17, wherein the input includes receiving a pointing device input indicating a cursor is within the first area.

21. The system of claim 14, further comprising a remote ad server operable to provide ad components to the ad server through a second network.

22. The system of claim 14, further comprising an ad submission interface operable to receive ad components for storage on the ad server.

23. The system of claim 14, further comprising an ad accounting server operable to receive data related to ad presentation and data related to ad responses.

24. The system of claim 14, wherein the input from the person causes the portion of the selected ad components to be electronically stored in an account accessible by the person.

25. The system of claim 14, wherein the frequency is inversely proportional to the amount of a wager by the player at the one or more selected devices.

26. A non transitory machine-readable medium having machine executable instructions stored thereon, that when executed, cause one or more processors to perform a method, the method comprising:

receiving, by a server on a wagering game machine network, ad components for an ad, the wagering game machine network including one or more wagering game machines operable to present a wagering game upon which monetary value may be wagered;

selecting one or more devices to present the ad; and selecting one or more of the components for the ad based on the capabilities of the one or more devices to receive the ad;

sending the selected one or more ad components to the one or more devices operable to display the selected ad components to a person in proximity to at least one of the devices, and receive input from the person, the input causing at least a portion of the selected ad components to be stored for later access by the person; and controlling, by the one or more processors and independent from player configuration, the frequency of sending the selected one or more ad components to the one or more devices based on game play characteristics of a player at the one or more devices.

* * * * *

UNITED STATES PATENT AND TRADEMARK OFFICE

CERTIFICATE OF CORRECTION

PATENT NO. : 8,414,374 B2
APPLICATION NO. : 12/532786
DATED : April 9, 2013
INVENTOR(S) : Pacey et al.

It is certified that error appears in the above-identified patent and that said Letters Patent is hereby corrected as shown below:

Title page 2, in column 2, under "Other Publications", line 2, after "Report", delete "and", therefor Title page 2, in column 2, under "Other Publications", line 4, after "Opinion", delete "and", therefor In the Specification In column 2, line 59, delete "132" and insert --130--, therefor In column 3, line 33, delete "214" and insert --214.--, therefor In column 3, line 64, delete "250," and insert --240,--, therefor In column 4, line 4, delete "by" and insert --be--, therefor In column 8, line 1, delete "the" and insert --that--, therefor In column 8, line 2, delete "add" and insert --ad--, therefor In column 9, line 50, delete "Or" and insert --or--, therefor In column 17, line 20, delete "418" and insert --718--, therefor In the Claims In column 18, line 29, in Claim 3, after "the", insert --ad--, therefor In column 19, line 31, in Claim 16, after "of", insert --a--, therefor In column 20, line 19, in Claim 26, delete "non transitory" and insert --non-transitory--, therefor Signed and Sealed this
Twelfth Day of November, 2013

Teresa Stanek Rea

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,414,374 B2
APPLICATION NO. : 12/532786
DATED : April 9, 2013
INVENTOR(S) : Pacey et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 314 days.

Signed and Sealed this
Eleventh Day of March, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,414,374 B2
APPLICATION NO. : 12/532786
DATED : April 9, 2013
INVENTOR(S) : Pacey et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 436 days.

Signed and Sealed this
First Day of September, 2015

Michelle K. Lee

Michelle K. Lee
*Director of the United States Patent and Trademark Office*